United States Patent [19]

Tosato et al.

[11] 4,345,671

[45] Aug. 24, 1982

[54] APPARATUS AND METHOD FOR INSTALLING ELEVATOR GUIDE RAILS

[75] Inventors: Larry P. Tosato, Millburn, N.J.; Henry A. Wehrli, Monroeville, Pa.; Robert C. Stewart, deceased, late of Morris, N.J., by Dorothy M. Stewart, executrix

[73] Assignee: Westinghouse Electric Corp., Pittsburgh, Pa.

[21] Appl. No.: 129,531

[22] Filed: Mar. 12, 1980

[51] Int. Cl.[3] ..... B66B 7/02

[52] U.S. Cl. ..... 187/95; 29/429

[58] Field of Search ..... 187/1 R, 95; 29/429; 52/741, 745; 254/89 R, 89 H; 414/745, 747

[56] References Cited

U.S. PATENT DOCUMENTS

| | | | |
|---|---|---|---|
| 2,993,679 | 7/1961 | Morgan | 29/429 |
| 3,211,427 | 10/1965 | Bristow, Jr. | 29/429 |
| 3,266,211 | 8/1966 | Hughes | 52/745 |
| 3,851,736 | 12/1974 | Westlake et al. | 187/95 |
| 3,893,219 | 7/1975 | Davis | 29/429 |

*Primary Examiner*—Robert J. Spar
*Assistant Examiner*—Kenneth Noland
*Attorney, Agent, or Firm*—D. R. Lackey

[57] ABSTRACT

A guide rail section is pushed up a hoistway through a guide funnel by a hydraulic lift pad. The guide funnel is detachably mounted to a wall bracket. The guide rail section is retained in the hoistway while the lift pad is lowered. Another guide rail section is positioned on the lift pad and aligned with the guide rail section retained in the hoistway. The aligned guide rail sections are connected by a fishplate. The guide rail section retained in the hoistway is released and the lift pad is raised pushing the connected guide rail sections up the hoistway through guide funnels. The procedure is repeated until a stack of guide rail sections of the appropriate length is assembled.

12 Claims, 7 Drawing Figures

APPARATUS AND METHOD FOR INSTALLING ELEVATOR GUIDE RAILS

BACKGROUND OF THE INVENTION

1. Field of the Invention

This invention relates generally to an elevator system wherein an elevator car operates in a hoistway utilizing vertical guide rails, and more specifically to an apparatus and method for installing the vertical guide rails.

2. Description of the Prior Art

The conventional method of installing elevator guide rails in a hoistway begins with the first step of installing wall brackets in vertical alignment in the hoistway. A rail section is brought into the hoistway and, starting in the pit, is attached to the brackets by rails clips. A second rail section is brought into the hoistway, vertically aligned with the first rail section, conected thereto by a fishplate, and attached to the wall brackets by rail clips. In this manner, the guide rail is assembled sectionally as the workers move up the hoistway.

Another method for installing elevator guide rails is disclosed in U.S. Pat. No. 3,893,219. Disclosed therein is an apparatus for suspending elevator guide rails from the top of a hoistway and a method for employing the apparatus to lower guide rails, comprising a string of interconnected guide rail sections, down a hoistway, section by section.

Another method for installing elevator guide rails is disclosed in U.S. Pat. No. 3,851,736, which is assigned to the same assignee as the present invention. Disclosed therein is an apparatus which is lowered by a hoist towards the lower end of the hoistway. For each guide rail desired, a guide rail section is connected to the apparatus. The apparatus is raised in steps, each of which is equal to the length of a guide rail section. At the end of each step an additional guide rail section is connected to the lower end of each row of suspended guide rail sections until the desired guide rail length is achieved. The guide rail is then connected to the building structure by wall brackets and rail clips.

SUMMARY OF THE INVENTION

In the present invention a first guide rail section is positioned on a hydraulic lift pad. The lift pad is raised, pushing the guide rail section up the hoistway through guide funnels detachably mounted to wall brackets. The first guide rail section is then retained in the hoistway by a clamp or similar means. The lift pad is lowered and a second guide rail section is positioned thereon. When the second guide rail section is positioned on the lift pad, its upper end is adjacent to the lower end of the guide rail section retained in the hoistway. The adjacent guide rail section ends are vertically aligned and are connected by means of a fishplate and associated hardware. The first guide rail section retained in the hoistway is released and the hydraulic lift pad is again raised. Raising the hydraulic lift pad pushes the connected guide rail sections up the hoistway. The guide rail sections in the hoistway are retained and the lift pad is once again lowered. This procedure is repeated until a guide rail of the desired length is assembled. Workers then move up through the hoistway in a sling removing the guide funnels and attaching the guide rail to the wall brackets.

The present invention has several advantages over the prior art. First, only one man need work in the hoistway thus minimizing the risk of injury due to falling objects. Second, since the man in the hoistway remains in the same location, substantial time is saved over the conventional method wherein the worker must continually reposition himself further up the hoistway as more and more rail sections are connected. Additionally, since the man in the hoistway is located in one position, overhead protection may be provided. With the conventional method, when overhead protection is provided the worker must continually disassemble, and assemble, the overhead protection as he relocates himself further up the hoistway. Finally, the present invention may be utilized under conditions where it is inconvenient to work from the top of the hoistway. These and other advantages are discussed in detail hereinbelow.

DESCRIPTION OF THE PREFERRED EMBODIMENT

Figures 1, 2:
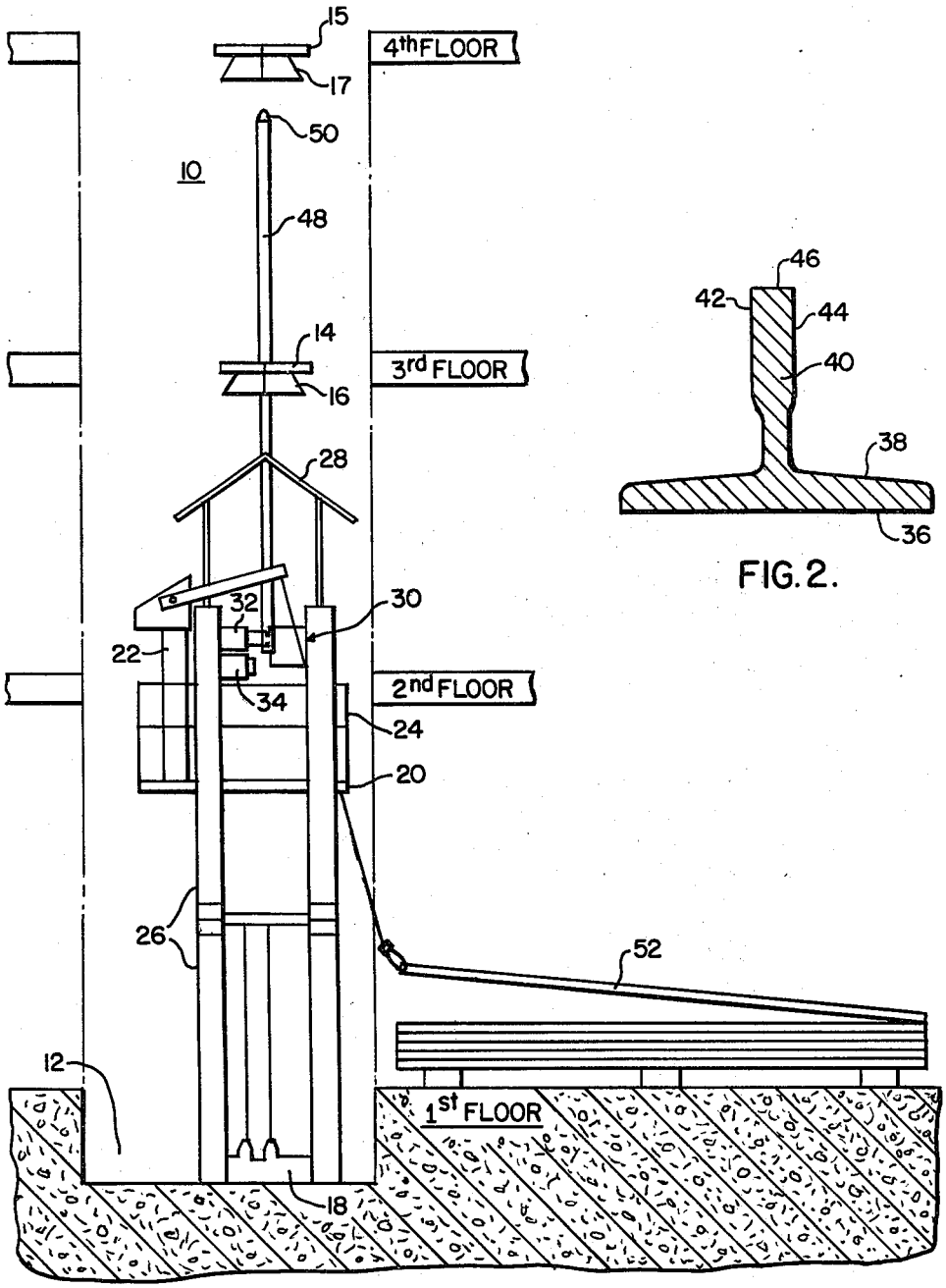
FIG. 1 is a schematic view of an elevator hoistway and the equipment for installing an elevator guide rail in the hoistway.
FIG. 2 is a sectional view of a T-shaped guide rail section.

Referring to the drawings, FIG. 1 illustrates an elevator hoistway 10 outlined by broken lines for serving landings or floors 1, 2, 3, and 4 of a building structure. The hoistway 10 has a pit 12 extending below the first floor. Two vertical car guide rails and two vertical counterweight guide rails are to be installed in the hoistway 10. For purposes of illustration, each guide rail is assumed to be constructed of guide rail sections mounted end to end, with each guide rail section being sixteen feet long.

The position of the guide rails is predetermined by the installation of wall brackets. For each guide rail a set of wall brackets is installed along a vertically straight path, or plum line, at each floor. Each wall bracket has a guide funnel detachably mounted thereto. In FIG. 1 wall brackets 14 and 15 are shown. The wall brackets 14 and 15 have guide funnels 16 and 17, respectively, mounted thereto.

Located in the pit 12 is a hydraulic lift pad 18. A work platform 20 is located approximately twelve feet above the pit 12. The work platform 20 supports a crane 22. The work platform 20 is supported by a scaffold 26. The scaffold 26 also supports overhead protection 28 and a guard rail 24 for the work platform 20, a clamping surface 30, a first hydraulic clamp 32, and a second hydraulic clamp 34.

The guide rail sections used in conjunction with the equipment described in FIG. 1 have a T-shaped cross-sectional area as illustrated in FIG. 2. Each of the guide rail sections has a flat back surface 36 and a flange 38. A stem 40 extends perpendicularly from the back surface 36. The stem 40 has a first side guide surface 42, a second side guide surface 44, and a nose or face guide surface 46.

Returning to FIG. 1, a first guide rail section 48 is positioned on the lift pad 18. The orientation of the first guide rail section 48 is such that the back surface 36 is visible in FIG. 1. A guide nose 50 is attached to the first guide rail section 48 for smoothly guiding the guide rail section 48 through the guide funnels 16 and 17. The lift pad 18 is raised a distance substantially equal to the length of the first guide rail section 48 such that the guide rail section 48 is pushed up the hoistway 10 through the guide funnel 16. The stem 40 of the first guide rail section 48 is clamped between the clamping surface 30 and the first hydraulic clamp 32 such that the first guide rail section 48 is retained in the hoistway 10. The hydraulic lift pad 18 is returned to the pit. The performance of these steps results in the position of the first guide rail section 48 as illustrated in FIG. 1.

Continuing the discussion of the method for installing the guide rail in conjunction with FIG. 1, a second guide rail section 52 is positioned on the lift pad 18 by the crane 22. The lift pad 18 is raised slightly to bring the adjacent ends of the first guide rail section 48 and the second guide rail section 52 into contact. The workmen align the nose guide surface 46 of the second guide rail section 52 with the nose guide surface 46 of the first guide section 48. When this alignment is completed, the first guide surface 42 and the second guide surface 44 of the second guide rail section 52 are aligned with the first guide surface 42 and the second guide surface 44, respectively, of the first guide rail section 48 by clamping the stem of the second guide rail section 52 between the clamping surface 30 and the second hydraulic clamp 34. The second hydraulic clamp 34 insures good vertical alignment between the first guide rail section 48 and the second guide rail section 52. The second guide rail section 52 is connected to the first guide rail section 48 by means of a fishplate and bolts (not shown in FIG. 1).

After the first and second guide rail sections 48 and 52, respectively, have been connected by the fishplate a slide cover (not shown in FIG. 1) is placed over the fishplate and associated bolts. The slide covers are provided so that the fishplates and associated bolts will pass smoothly through the guide funnels 16 and 17. After the slide cover is mounted over the fishplate the first clamp 32 and the second clamp 34 are released. The lift pad 18 is again raised a distance substantially equal to the length of a guide rail section such that both the first 48 and the second 52 guide rails sections are pushed up the hoistway 10. The first and second guide rail sections 48 and 52, respectively, are retained in the hoistway 10 by the clamp 32. The lift pad 18 is lowered and the procedure is repeated until a stack of guide rail sections of the appropriate length is assembled. Workmen will then go up the hoistway 10 in a sling to remove the guide funnels, to attach the completed guide rail to the wall brackets by means of rail clips (not shown), and to remove the guide nose 50.

Figure 3:
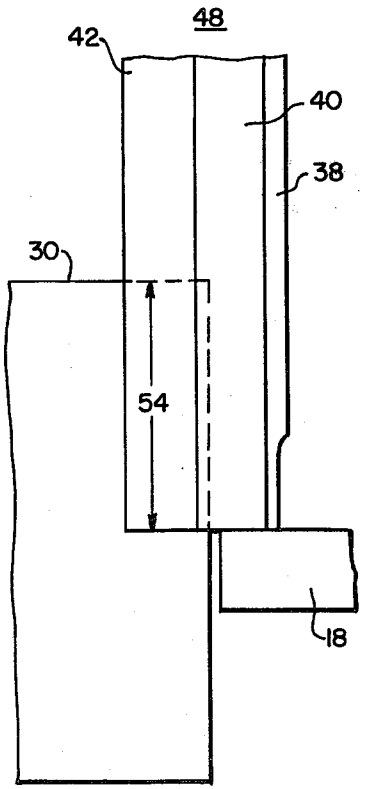
FIG. 3 is a schematic illustrating the method for retaining a stack of guide rail sections in a hoistway.

Turning now to FIG. 3 the method of retaining the first guide rail section 48 in the hoistway 10 is illustrated. The first guide rail section 48 is pushed up the hoistway 10 by the hydraulic lift pad 18. The hydraulic lift pad 18 is in contact with the end of the flange 38 and a portion of the end of the stem 40 of the first guide rail section 48. The first guide rail section 48 is retained in the hoistway 10 by the first hydraulic clamp 32 (not shown in FIG. 3). The first hydraulic clamp 32 contacts the first side guide surface 42 of the first rail section 48 in an area 54. In this manner the first guide rail section 48 is retained in the hoistway 10 as the hydraulic lift pad 18 is lowered.

Figure 4:
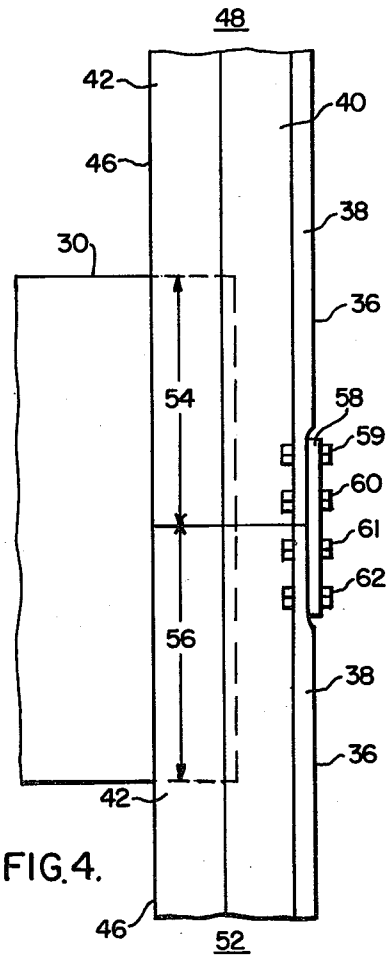
FIG. 4 is a schematic illustrating the method for aligning a guide rail section with the guide rail sections retained in the hoistway.

Turning now to FIG. 4 the second guide rail section 52 is positioned colinearly with the first guide rail section 48. The face guide surface 46 of the second guide rail section 52 is aligned with the face guide surface 46 of the first guide rail section 48. The first guide surface 42 and the second guide surface 44 of the second guide rail section 52 are aligned with the first side guide surface 42 and the second side guide surface 44, respectively, of the first guide rail section 48 by the second hydraulic clamp 34 (not shown in FIG. 4). The second hydraulic clamp 34 contacts the first side guide surface 42 of the second guide rail section 52 in an area 56 thus clamping the second guide rail section 52 against the clamping surface 30. The second guide rail section 52 is connected to the first guide rail section 48 by a fishplate 58 and bolt pairs 59 through 62, inclusive. In this manner a stack of guide rail sections is assembled producing a guide rail having minimal misalignment between guide rail sections.

Figure 5:
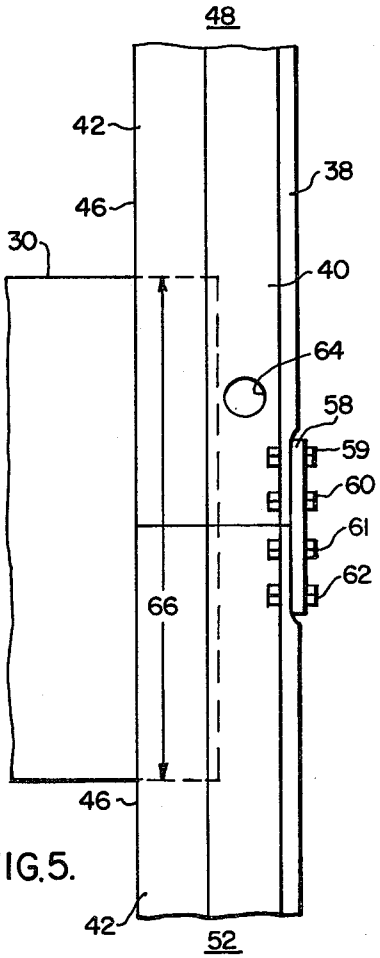
FIG. 5 illustrates another method for retaining a stack of guide rail sections in a hoistway.

Turning now to FIG. 5, another method for retaining the first guide rail section 48 in the hoistway 10 is illustrated. In place of the first hydraulic clamp 32 each guide rail section is provided with an opening 64. The opening 64 is located in the stem 40 of the first guide rail section 48 above the flange 38 and below the first 42 and second 44 side guide surfaces. A pin (not shown) extends through the opening 64 for retaining the first guide rail section 48 in the hoistway 10. The face guide surface 46 of the second guide rail section 52 is aligned with the face guide surface 46 of the first guide rail section 48. The first side guide surface 42 and the second side guide surface 44 of the second guide rail section 52 are aligned with the first side guide surface 42 and the second side guide surface 44, respectively, of the first guide rail section 48 by the second hydraulic clamp 34 (not shown in FIG. 5) now having an enlarged contact area 66. The second guide rail section 52 is connected to the first guide rail section 48 by the fishplate 58 and bolt pairs 59 through 62 as in FIG. 4.

Figure 6:
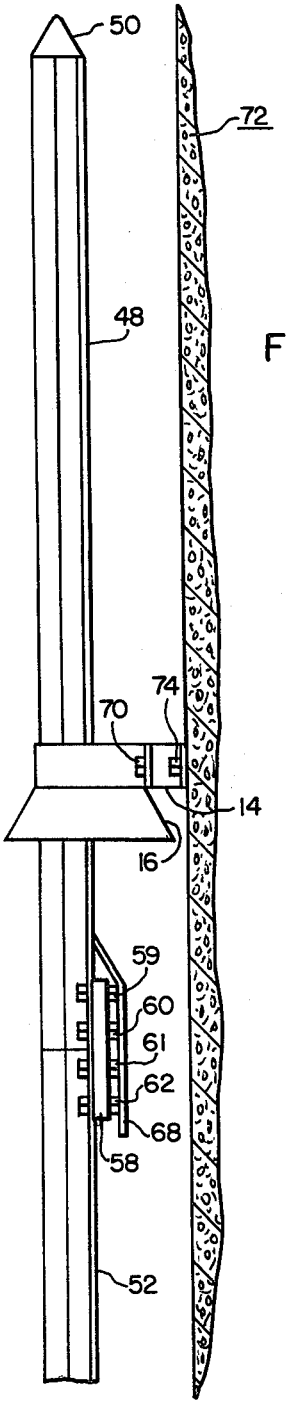
FIGS. 6 and 7 illustrate a guide funnel.

In FIG. 6 the wall bracket 14 is mounted to a wall 72 by a pair of bolts 74, only one of which is shown in FIG. 6. The guide funnel 16 is mounted to the wall bracket 14 by a pair of bolts 70, only one of which is shown in FIG. 6. The first guide rail section 48, having the guide nose 50 attached thereto, is connected to the second guide rail section 52 by the fishplate 58 and the bolt pairs 59 through 62. The fishplate 58 and associated bolt pairs 59 through 62 are covered by a slide cover 68. The slide cover allows the fishplate 58 and associated bolt pairs 59 through 62 to pass smoothly through the guide funnel 16 as the stack of guide rail sections is pushed up the hoistway 10.

Figure 7:
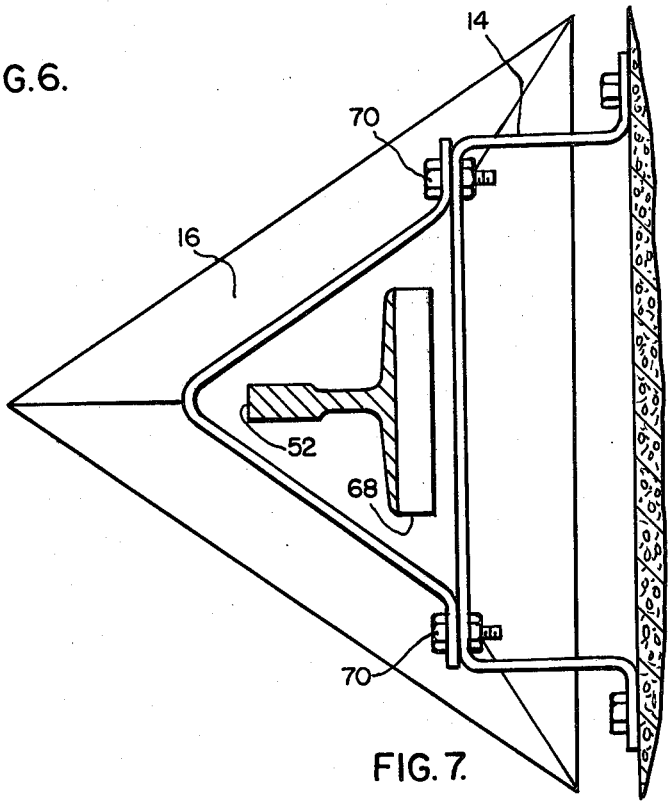

Another view of the guide funnel 14 is shown in FIG. 7. In FIG. 7 the second guide rail section 52 and the slide cover 68 are shown in the guide funnel 16. The guide funnel 16 is constructed such that there is approximately ½ inch clearance around the guide rail section 52 and the slide cover 68. When the assembly of guide rail sections is completed, workmen working in the hoistway using a sling will remove the guide funnel 16 by removing the bolts 70. The completed guide rail will then be attached to the wall bracket 14 by means of rail clips (not shown) utilizing the same bolt holes as the bolts 70.

Briefly reviewing, an apparatus and method for installing elevator guide rails is disclosed wherein a guide rail section is pushed up a hoistway through a guide funnel by a hydraulic lift pad. The guide rail section is retained in the hoistway. The hydraulic lift pad is lowered, and a second guide rail section is positioned thereon. The two guide rail sections are vertically aligned and connected together by a fishplate. After alignment and connection the guide rail section retained in the hoistway is released. The hydraulic lift pad then pushes the connected guide rail sections up the hoistway through guide funnels. The procedure is repeated until a stack of guide rail sections of the appropriate length is assembled.

What is claimed is:

1. A system for installing elevator guide rails in a hoistway constructed of guide rail sections, comprising:

a plurality of wall brackets located in vertical alignment along said hoistway;

a plurality of guide funnels detachably mounted to said wall brackets;

means for pushing said guide rail sections up said hoistway through said guide funnels;

guide means detachably mounted to the first guide rail section pushed up said hoistway for smoothly guiding said guide rail section through said plurality of guide funnels;

means for retaining said guide rail sections in said hoistway; and means for aligning a guide rail section colinearly with said guide rail sections retained in said hoistway such that said aligned guide rail section may be connected to said guide rail sections retained in said hoistway to provide said vertically straight guide rail.

2. The system as claimed in claim 1 wherein the guide rail sections have an opening extending therethrough, and wherein the retaining means includes a pin extending through said opening in said guide rail sections.

3. The system as claimed in claim 1 wherein the retaining means includes a hydraulic clamp.

4. The system as claimed in claim 1 including fishplates for connecting the aligned guide rail section to the guide rail sections retained in the hoistway, and including slide covers covering said fishplates such that said fishplates pass smoothly through the plurality of guide funnels.

5. The system as claimed in claim 1 wherein the means for pushing includes a hydraulic lift pad.

6. The system as claimed in claim 5 including a protected platform housing both the means for retaining and the means for aligning, and including means for positioning the guide rail sections such that one end of said guide rail section is on the lift pad and the other end is adjacent the end of the guide rail sections retained in the hoistway.

7. A method for installing elevator guide rails in a hoistway constructed of guide rail sections, comprising the steps of:

(a) attaching a guide means to a first guide rail section;

(b) pushing said guide rail section up said hoistway;

(c) retaining said guide rail section in said hoistway;

(d) aligning a next guide rail section colinearly with said guide rail section in said hoistway;

(e) connecting said aligned guide rail section to said guide rail section in said hoistway;

(f) releasing said guide rail section retained in said hoistway;

(g) repeating steps (b) through (f) until said guide rail of the desired length is assembled.

8. The method as claimed in claim 7 including a step of positioning the guide rail section on a lift pad, and wherein the step of pushing said guide rail section includes a step of raising said lift pad a distance substantially equal to the length of said guide rail section.

9. The method as claimed in claim 8 including a step of lowering the lift pad after the step of retaining the guide rail section.

10. The method as claimed in claim 8 wherein the step of aligning the guide rail section includes the steps of positioning said guide rail section on the lift pad, and clamping both the end of said guide rail section on said lift pad and the end of the guide rail section in the hoistway such that said guide rail sections are vertically aligned.

11. The method as claimed in claim 7 wherein the step of connecting the aligned guide rail section includes a step of covering said connection with a slide cover.

12. A method for installing elevator guide rails in a hoistway constructed of guide rail sections, comprising the steps of:

(a) attaching a nose guide to said guide rail section;

(b) positioning said guide rail section on a lift pad;

(c) raising said lift pad a distance substantially equal to the length of said guide rail section such that said guide rail section is pushed up said hoistway;

(d) retaining said guide rail section in said hoistway;

(e) lowering said lift pad;

(f) positioning a guide rail section on said lift pad;

(g) clamping both the end of said guide rail section on said lift pad and the end of said guide rail in said hoistway such that said guide rail sections are vertically aligned;

(h) connecting said aligned guide rail sections with a fishplate;

(i) covering said fishplate with a slide cover;

(j) unclamping said aligned guide rail section ends;

(k) releasing said guide rail section retained in said hoistway;

(l) repeating steps (c) through (k) until said guide rail of the desired length is assembled.

* * * * *